United States Patent [19]

Takashima et al.

[11] Patent Number: 4,834,064

[45] Date of Patent: May 30, 1989

[54] COMBUSTION APPARATUS

[75] Inventors: Tadashi Takashima, Nara; Masayuki Fujimoto, Yamatokoriyama, both of Japan

[73] Assignee: Matsushita Electric Industrial Co., Ltd., Osaka, Japan

[21] Appl. No.: 159,519

[22] Filed: Feb. 19, 1988

Related U.S. Application Data

[63] Continuation of Ser. No. 664,751, Oct. 25, 1984, abandoned.

[30] Foreign Application Priority Data

| | | | |
|---|---|---|---|
| Oct. 26, 1983 | [JP] | Japan | 58-165645[U] |
| Oct. 26, 1983 | [JP] | Japan | 58-165649[U] |
| Oct. 31, 1983 | [JP] | Japan | 58-204075 |
| Oct. 31, 1983 | [JP] | Japan | 58-168837[U] |
| Nov. 1, 1983 | [JP] | Japan | 58-205122 |
| Nov. 1, 1983 | [JP] | Japan | 58-169535[U] |

[51] Int. Cl.[4] ..... F24C 5/04

[52] U.S. Cl. ..... 126/96; 126/512; 126/523; 126/552

[58] Field of Search ..... 126/62, 63, 86, 88, 126/89, 92 R, 92 AC, 92 B, 92 C, 95, 96

[56] References Cited

U.S. PATENT DOCUMENTS

| | | | |
|---|---|---|---|
| 1,703,459 | 2/1929 | Sala . | |
| 1,726,000 | 8/1929 | Sala . | |
| 2,072,048 | 2/1937 | Leonard . | |
| 2,293,202 | 8/1942 | Gardner . | |
| 2,591,039 | 4/1952 | Barnes . | |
| 2,696,205 | 12/1954 | Ruhl . | |
| 2,859,742 | 11/1958 | Ruhl . | |
| 3,952,721 | 4/1976 | Patterson | 126/63 |
| 4,361,131 | 11/1982 | Homolik | 126/123 |
| 4,374,514 | 2/1983 | Pierce | 126/63 |
| 4,441,482 | 4/1984 | Luscombe | 126/123 |
| 4,488,536 | 12/1984 | Kojima et al. | 126/96 |
| 4,492,218 | 1/1985 | Uchida et al. | 126/96 |

FOREIGN PATENT DOCUMENTS

| | | | |
|---|---|---|---|
| 48-39560 | 11/1973 | Japan . | |
| 49-6199 | 2/1974 | Japan . | |
| 49-8570 | 2/1974 | Japan . | |
| 6254 | 1/1982 | Japan | 126/96 |

*Primary Examiner*—Larry Jones

*Attorney, Agent, or Firm*—Birch, Stewart, Kolasch & Birch

[57] ABSTRACT

A combustion apparatus including a housing formed with an opening, a combustion tube provided in the opening, a reflector disposed rearwardly of the combustion tube, and at least one heat shielding plate disposed between the combustion tube and a top plate of the housing such that at least one gap for allowing convected air to flow therethrough is defined between the heat shielding plate and the top plate. Furthermore, a front end of the heat shielding plate is projected forwardly of the top plate.

17 Claims, 5 Drawing Sheets

COMBUSTION APPARATUS

This application is a continuation of application Ser. No. 664,751 filed on Oct. 25, 1984, now abandoned.

BACKGROUND OF THE INVENTION

The present invention generally relates to combustion apparatuses and more particularly, to a combustion apparatus including a combustion apparatus housing having an opening formed at a front portion thereof, a combustion tube provided in the opening, and a top plate provided above the combustion tube.

Conventionally, in combustion-apparatus of the above described type, it has been so arranged that heating is performed through utilization of combustion gas and radiant heat emitted from the combustion tube in the opening formed at the front portion of the combustion apparatus housing. However, in the prior art combustion apparatus, as shown in FIG. 1, the high-temperature combustion gas discharged from a combustion tube 31 initially ascends vertically therefrom and then, comes into contact with a top plate 32 so as to be carried forwardly of the top plate 32 as indicated by the arrow H. Accordingly, in the known combustion apparatus, there is such a danger that since the temperature of the top plate 32 rises extremely, the user gets burnt through inadvertent touching with the heated top plate 32.

In order to lessen the danger referred to above, there has been proposed a combustion apparatus in which a heat shielding plate 33 is provided below the top plate 32 as shown in the one-dot chain lines in FIG. 1 so as to prevent the temperature of the top plate 32 from rising exceedingly. However, even in this known combustion apparatus, such a disadvantage still exists that since the combustion gas flowing out of a front end 32*a* of the top plate 32 heats the front end 32*a*, the user gets burned by the heated front end 32*a*. Furthermore, in the prior art combustion apparatus, there is the inconvenience that since air trapped in a space T defined between the top plate 32 and the heat shielding plate 33 is gradually heated to a high temperature when the prior art combustion apparatus is used continuously for a long time, the top plate 32 is also heated to a high temperature with the result that the user gets burnt by the heated top plate 32.

SUMMARY OF THE INVENTION

Accordingly, an essential object of the present invention is to provide an improved combustion apparatus including a combustion apparatus housing having an opening formed at a front portion thereof, a combustion tube provided in the opening, and a top plate provided above the combustion tube, in which the top plate as a whole is maintained at a low temperature even after the combustion apparatus has been used continuously for a long time so as to obviate such a danger that the user gets burnt through inadvertent touching with the heated top plate, with substantial elimination of the disadvantages inherent in conventional combustion apparatus of this kind.

In order to achieve the above described object, in the combustion apparatus according to the present invention, at least one heat shielding plate is provided below the top plate so as to define a gap therebetween such that the gap acts as an air passage. Furthermore, it is so arranged that a front end of the heat shielding plate is projected forwardly of the top plate so as to prevent combustion gas from coming into direct contact with a front end of the top plate and air is caused to flow through the gap between the heat shielding plate and the top plate.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
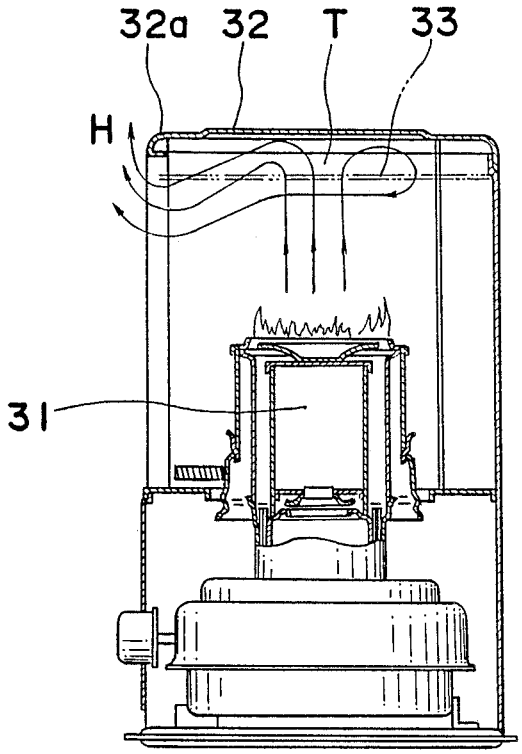
Fig. 1 PRIOR ART
FIG. 1 is a vertical sectional view of a prior art combustion apparatus (already referred to)
Figure 2:
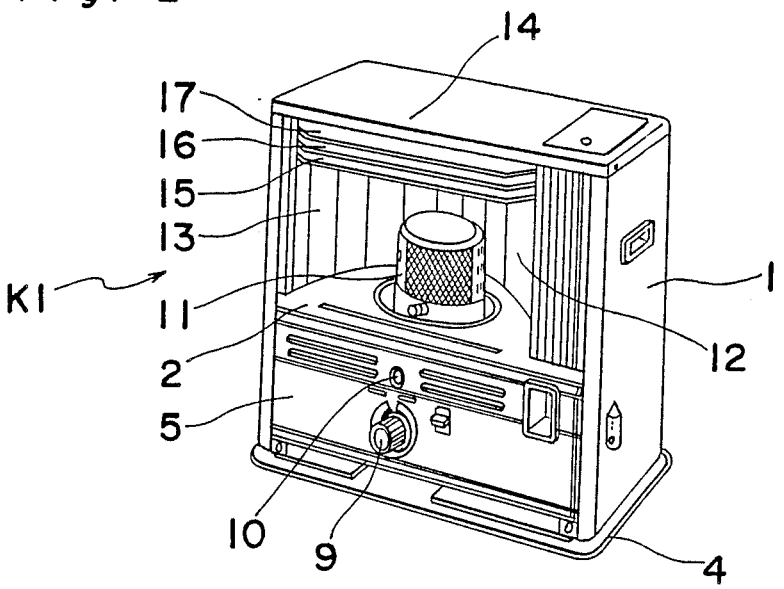
FIG. 2 is a perspective view of a combustion apparatus according to a first embodiment of the present invention.
Figure 3:
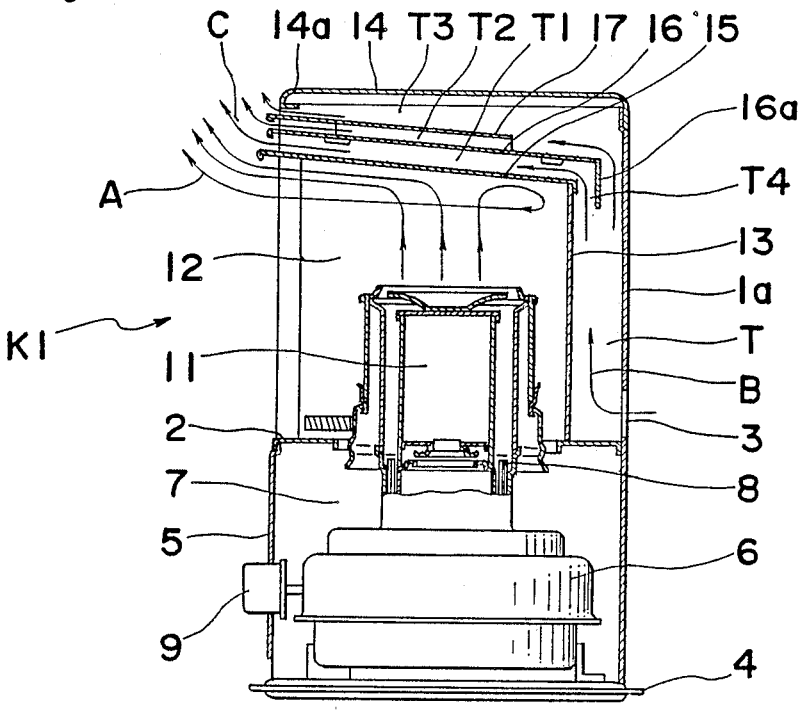
FIG. 3 is a vertical sectional view of the combustion apparatus of FIG. 2.

Referring now to the drawings, there is shown in FIGS. 2 and 3, a combustion apparatus K1 according to a first embodiment of the present invention. The combustion apparatus K1 is a kerosene heater in this embodiment and generally includes a combustion apparatus housing 1 having an opening formed at a front portion thereof, and a lower reflector 2 dividing the opening into an upper space 12 and a lower space 7. The housing 1 includes a rear plate 1*a* for covering a rear face of the housing 1, a top plate 14 for covering an upper face of the housing 1, a base plate 4 attached to a lower face of the housing 1 and a front plate 5 for covering a lower front face of the housing 1. Namely, the upper space 12 opens forwardly but the lower space 7 is covered by the front plate 5. The combustion apparatus K1 further includes a fuel tank 6 provided in the lower space 7 disposed below the lower reflector 2, and a wick 8 for sucking up and vaporizing fuel in the fuel tank 6, with the wick 8 being vertically movably provided. Meanwhile, the rear plate 1*a* has a plurality of holes 3 formed above the lower reflector 2.

The combustion apparatus K further includes a wick raising knob 9 for raising and lowering the wick 8, an ignition mechanism 10 for igniting the wick 8, a combustion tube 11 for burning the vaporized fuel from the wick 8, and a side reflector 13 surrounding rear peripheral portions of the combustion tube 11. The combustion tube 11 is inserted, at a lower portion thereof, through the lower reflector 2 so as to be placed on an upper portion of the fuel tank 6 such that an upper portion of the combustion tube 11 projects into the upper space 12. The side reflector 13 is intended to reflect forwardly of the housing 1 radiant heat from the combustion tube 11 and a gap T is defined between the side reflector 13 and the rear plate 1*a*.

Furthermore, the combustion apparatus K1 includes first, second and third heat shielding plates 15, 16 and 17. The first heat shielding plate 15 is attached to an upper portion of the side reflector 13 and is disposed below the top plate 14 so as to define a gap therebetween such that a front end of the first shielding plate 15 projects forwardly of the top plate 14. The second and third heat shielding plates 16 and 17 are disposed between the first heat shielding plate 15 and the top plate 14 so as to confront the first heat shielding plate 15 and the top plate 14, respectively such that first, second and third gaps T1, T2 and T3 acting as air passages are, respectively defined between the first and second heat shielding plates 15 and 16, between the second and third heat shielding plates 16 and 17 and between the third heat shielding plate 17 and the top plate 14. It is to be noted that front ends of the second and third heat shielding plates 16 and 17 are also so provided as to project forwardly of the top plate 14 as in the case of the first heat shielding plate 15. It is so arranged that the front ends of the third, second and first heat shielding plates 17, 16 and 15 are gradually further projected forwardly of the top plate 14 in this order such that the front end of the first heat shielding plate 15 disposed most adjacent to the combustion tube 11 is projected furthest forwardly of the top plate 14 and the first, second and third heat shielding plates 15, 16 and 17 are inclined obliquely upwardly toward the front ends of the first, second and third heat shielding plates 15, 16 and 17, respectively.

Meanwhile, the first gap T1 between the first and second heat shielding plates 15 and 16, the second gap T2 between the second and third heat shielding plates 16 and 17 and the third gap T3 between the third heat shielding plate 17 and the top plate 14 are communicated with the gap T between the side reflector 13 and the rear plate 1*a* so as to function as the air passages. The second heat shielding plate 16 is formed, at a rear end thereof, with a bent portion 16*a* projecting downwardly into the gap T.

By the above described arrangement of the combustion apparatus K1, when kerosene is filled into the fuel tank 6 and then, the wick 8 is ignited after the wick 8 has been raised by rotating the wick raising knob 9, combustion of the kerosene is started in the combustion apparatus K1, so that radiant heat is emitted from the combustion tube 11 so as to be reflected forwardly of the housing 1 by the side reflector 13 disposed rearwardly of the combustion tube 11 such that radiant heating is effected. Meanwhile, high-temperature combustion gas discharged from the combustion tube 11 ascends vertically and then, comes into contact with the first heat shielding plate 15 so as to flow forwardly out of the first heat shielding plate 15 along the first heat shielding plate 15 as shown by the arrow A in FIG. 3. Since the front end of the first heat shielding plate 15 is projected forwardly of the top plate 14, the high-temperature combustion gas is prevented from coming into contact with a front end 14*a* of the top plate 14 and thus, it becomes possible to maintain the top plate 14 at a low temperature. Moreover, in this embodiment, since the first, second and third heat shielding plates 15, 16 and 17 are inclined obliquely upwardly toward the front ends of the first, second and third heat shielding plates 15, 16 and 17, respectively, the high-temperature combustion gas flows vigorously forwardly so as to proceed further away from the front end 14*a* of the top plate 14, thereby effectively preventing the top plate 14 from being heated to a high temperature by the combustion gas.

On the other hand, while the combustion gas flows forwardly along the first heat shielding plate 15 after having come into contact worth the first heat shielding plate 15 as described above, the first heat shielding plate 15 and air in the first, second and third gaps T1, T2 and T3 disposed above the first heat shielding plate 15 are heated, so that a phenomenon of convection takes place and thus, air flows into the gap T through the holes 3 as shown by the arrow B in FIG. 3 so as to pass through the first, second and third gaps T1, T2 and T3 forwardly. Since there is a large difference in temperature between heated air in the first, second and third gaps T1, T2 and T3 and air drawn into the gap T, the convection is of rather high flow velocity. Accordingly, since the first, second and third heat shielding plates 15, 16 and 17 and the top plate 14 are at all times brought into contact with cold air so as to be cooled by the cold air, the top plate 14 is at all times maintained at a low temperature even after the combustion apparatus K1 has been operated for a long time. Furthermore, since the second and third heat shielding plates 16 and 17 are further provided between the top plate 14 and the first heat shielding plate 15, radiant heat from the first heat shielding plate 15 heated by the combustion gas discharged from the combustion tube 11 is shielded by the second and third heat shielding plates 16 and 17. In addition, since the second and third heat shielding plates 16 and 17 are at all times cooled by the convected air, the second and third heat shielding plates 16 and 17 do not act as a secondary radiant source and thus, the top plate 14 is maintained at a lower temperature. Since the above described convected air flows through the gap T between the rear plate 1*a* and the side reflector 13 via the holes 3 of the rear plate 1*a*, it becomes also possible to lower temperature of a rear portion of the housing 1. Moreover, since the second heat shielding plate 16 is formed, at its rear end, with the bent portion 16*a* projecting downwardly into the gap T between the side reflector 13 and the rear plate 1*a*, the amount of air flowing through the first gap T1 between the first and second heat shielding plates 15 and 16 can be increased by widening a gap T4 between the bent portion 16*a* and the side reflector 13 so as to further lower temperature of the top plate 14.

Figure 4:
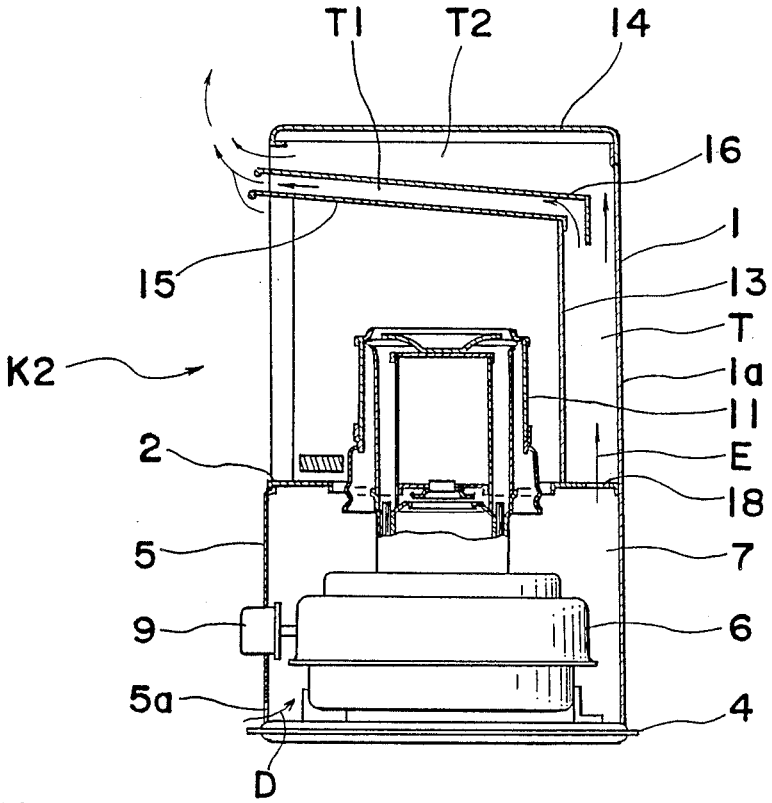
FIG. 4 is a view similar to FIG. 3, particularly showing a combustion apparatus according to a second embodiment of the present invention.

Referring to FIG. 4, there is shown a combustion apparatus K2 according to a second embodiment of the present invention, in which convected air is drawn from the lower space 7 for the fuel tank 6. Namely, in the combustion apparatus K2, a hole 18 for passing air therethrough is formed at a rear portion of the lower reflector 2 so as to communicate the gap T and the lower space 7 and only the first and second heat shielding plates 15 and 16 are provided. By this arrangement of the combustion apparatus K2, the convected air is caused to flow into the lower space 7 via an opening 5*a* of the front plate 5 as shown by the arrow D and then, is introduced into the space T through the hole 18 as shown by the arrow E. Accordingly, the combustion apparatus K2 achieves the same effects as those of the combustion apparatus K1 and further has such an advantage that since the fuel tank 6 is cooled by the air flowing through the lower space 7, the fuel tank 6 is prevented from being heated to a high temperature.

Figure 5:
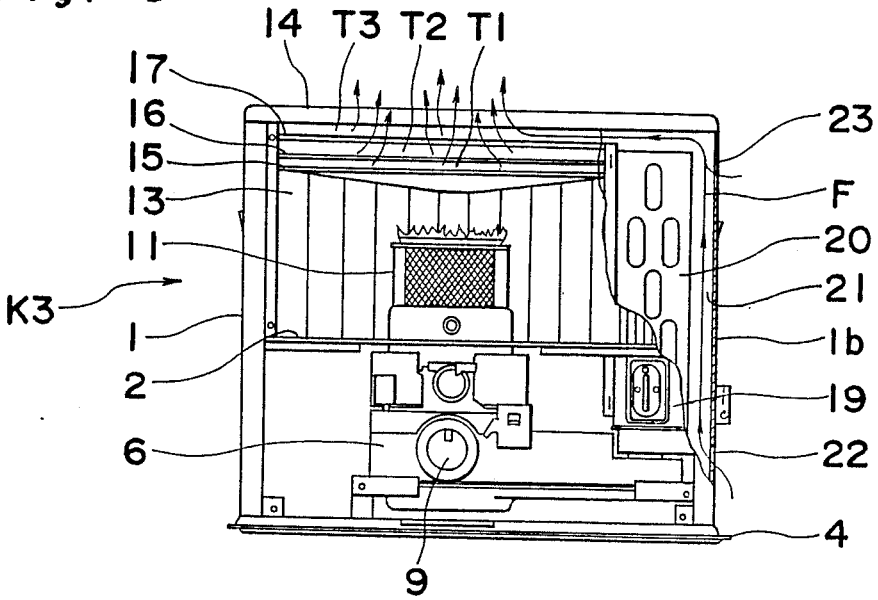
FIG. 5 is a partially cutaway front elevational view of a combustion apparatus according to a third embodiment of the present invention.

Referring to FIG. 5, there is shown a combustion apparatus K3 according to a third embodiment of the present invention, in which the convected air is drawn also from still another portion. Namely, the combustion apparatus K3 includes the first, second and third heat shielding plates 15, 16 and 17, a movable tank 19 for replenishing the fuel tank 6 with the fuel and a partition plate 20 disposed adjacent to one side plate 1*b* formed with holes 22 and 23. A space 21 is defined between the partition plate 20 and the side plate 1*b* such that the movable tank 19 is detachably fitted into the space 21. The space 21 is further communicated with the first, second and third gaps T1, T2 and T3 which are disposed between the first heat shielding plate 15 and the top plate 14. Accordingly, in the combustion apparatus K3, since the convected air is caused to flow as shown by the arrow F, such an advantage can be obtained that the side plate 1*b* and the movable tank 19 also can be cooled.

Figure 6:
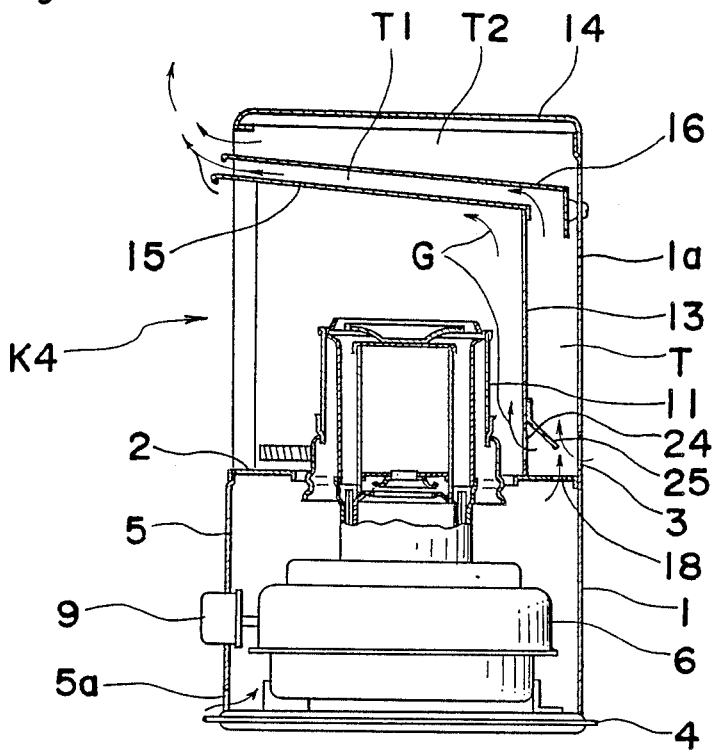
FIG. 6 is a view similar to FIG. 4, particularly showing a combustion apparatus according to a fourth embodiment of the present invention.

In FIG. 6, a combustion apparatus K4 according to a fourth embodiment of the present invention is shown. In the combustion apparatus K4 including the first and second heat shielding plates 15 and 16, the side reflector 13 is formed, at a lower portion thereof, with a hole 24 and a guide plate 25 is attached to a rear face of the side reflector 13 such that a portion of air flowing into the gap T through the hole 3 of the rear plate 3 and the hole 18 of the lower reflector 2 is guided by the guide plate 25 toward the combustion tube 11 via the hole 24. By the above described arrangement of the combustion apparatus K4, since air is caused to flow also below first the heat shielding plate 15 as shown by the arrow G so as to lower temperature of the combustion gas discharged from the combustion tube 11, the top plate 14 is more positively prevented from being heated to a high temperature.

Figure 7:
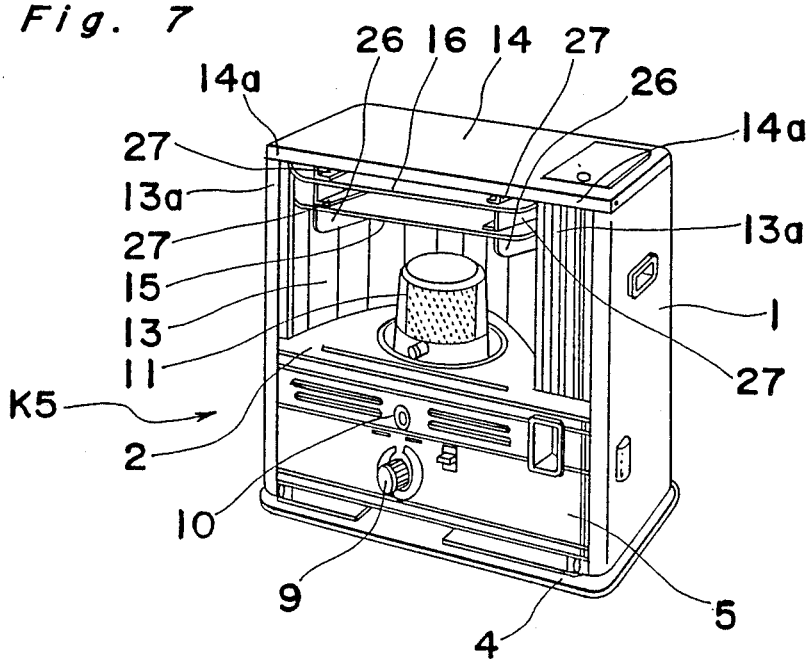
FIG. 7 is a view similar to FIG. 2, particularly showing a combustion apparatus according to a fifth embodiment of the present invention.
Figure 8:
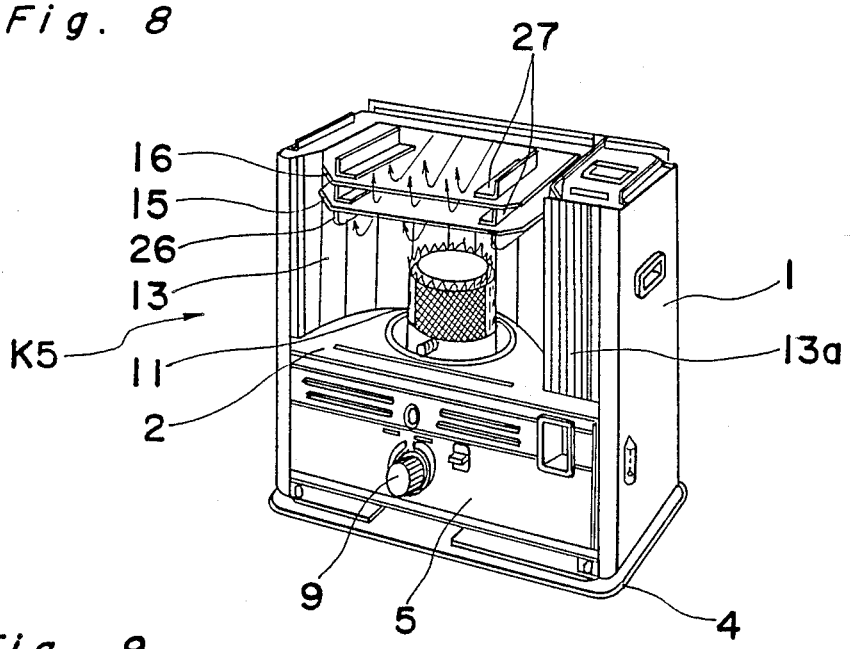
FIG. 8 is a view similar to FIG. 7, with a top plate employed therein being removed.
Figure 9:
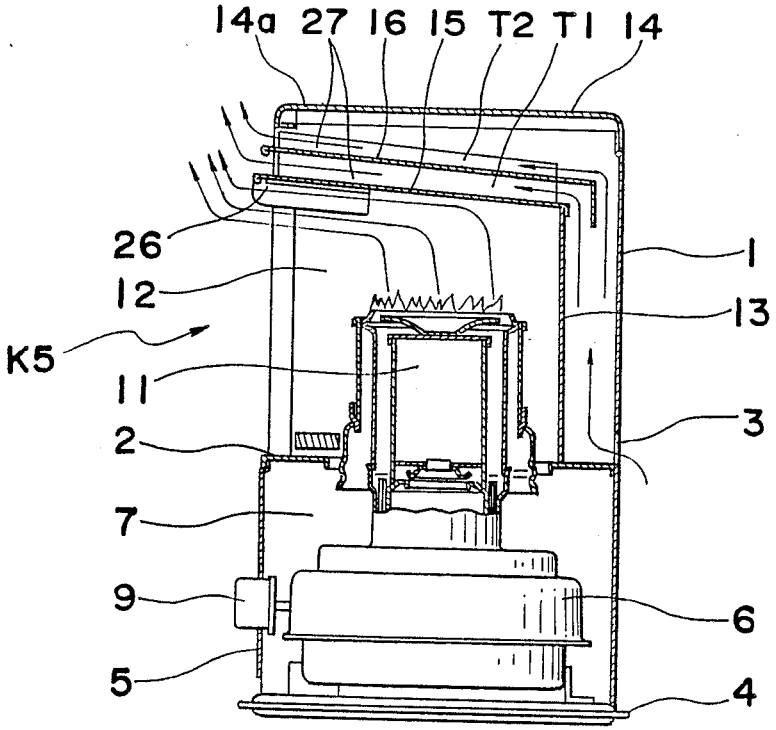
FIG. 9 is a vertical sectional view of the combustion apparatus of FIG. 7.

Referring further to FIGS. 7 to 9, there is shown a combustion apparatus K5 according to a fifth embodiment of the present invention, in which opposite side portions 14*a* of the top plate 14 are more securely prevented from being heated to a high temperature. The combustion apparatus K5 includes the first and second heat shielding plates 15 and 16, a pair of exhaust guides 26 secured to opposite side portions of a lower face of the first heat shielding plate 15, and two pairs of flow regulating plates 27 one pair of which are secured, between the first and second heat shielding plates 15 and 16, to opposite side portions of an upper face of the first heat shielding plate 15, with the other pair of the flow regulating plates 27 being secured, between the second heat shielding plate 16 and the top plate 14, to opposite side portions of an upper face of the second heat shielding plate 16. By this arrangement of the combustion apparatus K5, combustion gas, which ascends from the combustion tube 11 and then, proceeds forwardly along the first heat shielding plate 15 after having come into contact with the first heat shielding plate 15, is prevented by the exhaust guides 26 from being diffused, at the front end of the first heat shielding plate 15, toward left and right side portions of the first heat shielding plate 15 in FIG. 7. Thus, since the combustion gas is prevented from coming into contact with the opposite side portions 14*a* of the top plate 14 and opposite upper side portions 13*a* of the side reflector 13, the top plate 14 can be maintained at a still lower temperature. Furthermore, since the flow regulating plates 27 are provided between the first and second heat shielding plates 15 and 16 and between the second heat shielding plate 16 and the top plate 14, the convected air flowing into the gaps T1 and T2 is also prevented by the flow regulating plates 27 from being diffused, at the front ends of the first and second heat shielding plates 15 and 16 and the top plate 14, towards left and right portions of the first and second heat shielding plates 15 and 16 and the top plate 14 and thus, is caused to flow forwardly smoothly, so that it becomes possible to further lower temperature of the top plate 14.

As is clear from the foregoing description, in accordance with the present invention, since not only the central portion but also the front end portion of the top plate, namely the whole top plate can be positively prevented from being heated to a high temperature, it becomes possible to obtain a remarkably safe combustion apparatus.

Furthermore, in accordance with the present invention, even if the combustion apparatus is continuously operated for a long time, the top plate is maintained at a low temperature, thereby ensuring great safety of operation of the combustion apparatus.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A free-standing portable heater comprising:

a housing including a top plate, a rear plate and a front plate, said top plate having a front edge portion, said front edge portion and said front plate defining a front opening for the discharging of heat therefrom, a lower reflector dividing the space within said housing into an upper space and a lower space, said front plate covering the front portion of said lower space below said lower reflector, a heating means comprising a combustion tube mounted on a fuel tank, said fuel tank supplying fuel to said heating means for generating heat, said heating means extending from the lower space into said upper space, a side reflector disposed behind said heating means in said upper space, said reflector being spaced apart from said rear plate for defining a rear gap therebetween, a plurality of heat shielding plates disposed between the heating means and the top plate for defining a plurality of convection gaps therebetween, said convection gap communicating at one end to said rear gap and at the other end to the front opening for allowing cooling air to flow therethrough, said heat shielding plates and said front plate defining an opening for the discharge of heat therefrom said heating shielding plates being included obliquely upward toward the front opening and extending beyond the front edge portion of said top plate, the front end of the lowermost heat shielding plate extending beyond the front end of the next adjacent heat shielding plate so that the front ends of said plurality of heat shielding plates are disposed in a stair step configuration, whereby the heat generated from the heating means is discharged beyond said front edge of the heat shielding plates disposed between the lowermost heat shielding plate and the top plate, thereby maintaining the top plate in a cool state, and means for permitting ambient air to flow into said rear and top convection gaps for discharge above said heat shielding plates.

2. The portable heater of claim 1 wherein said means for permitting ambient air to flow into said rear and said top convection gaps is aperture means disposed in the rear plate.

3. The portable heater of claim 2 wherein said means for permitting ambient air to flow into said rear and said top gaps further includes aperture means disposed in said front plate, aperture means disposed in said lower reflector to provide communication between said lower space of said housing and said rear gap, and aperture means disposed in said side reflector for circulating a portion of the convection air into the upper space surrounding the heating means.

4. The portable heater of claim 3 wherein a guide plate is disposed above the aperture provided in the side reflector.

5. The portable heater of claim 1 wherein one of said shielding plates disposed between adjacent convection gaps extends into said rear gap to split the air flowing therethrough into said plurality of convection gaps.

6. The portable heater of claim 1 wherein said means for permitting ambient air to flow into said rear and said top convection gaps includes aperture means disposed in said front plate and aperture means disposed in said lower reflector to provide communication between said lower space of said housing and said rear gap.

7. The portable heater of claim 6 wherein said fuel tank is disposed in the lower space of said housing whereby ambient air entering the aperture means in said front plate passes over and cools said fuel tank as it is exhausted through said rear gap and above said front opening.

8. The portable heater of claim 1 wherein a pair of exhaust guides are secured to opposite side portions of the lower face of the lowermost heat shielding plate, said exhaust guides facing the upper space of the housing.

9. The portable heater of claim 1 wherein flow regulating plates are disposed between adjacent shielding plates and between the top plate and the uppermost shielding plate, on opposite sides thereof.

10. The portable heater of claim 1 further including a movable, auxiliary tank for replenishing said fuel tank with fuel, said movable, auxiliary tank being provided in a side space defined by the side reflector and a side plate of said housing, said side space communicating with said convection gap, and aperture means in said side plate for introducing ambient air into said side space.

11. The portable heater of claim 1 wherein a wick is operatively connected to said combustion tube for sucking up and vaporizing fuel in said tube.

12. A portable heater comprising:

a housing including a top plate, a rear plate and a front plate, said top plate having a front edge portion, said front edge portion and said front plate defining a front opening for the discharge of heat therefrom;

a lower reflector dividing the space within said housing into an upper space and a lower space, said front plate covering the front portion of said lower space below said lower reflector, a heating means for generating heat, said heating means extending into said upper space, a side reflector disposed behind said heating means in said upper space, said reflector being spaced apart from said rear plate for defining a rear gap therebetween, a plurality of heat shielding plates disposed between the heating means and the top plate for defining a plurality of convection gaps therebetween, said convection gaps communicating at one end to said rear gap and at the other end to the front opening for allowing cooling air to flow therethrough, said heat shielding plates and said front plate defining an opening for the discharge of heat therefrom, said heating shielding plates being included obliquely upward from the front opening and extending beyond the front edge portion of said top plate, the front end of the lowermost heat shielding plate extending beyond the front end of the next adjacent heat shielding plate so that the front ends of said plurality of heat shielding plates are disposed in a stair step configuration, whereby the heat generated from the heating means is discharged beyond said front edge portion of said top plate, as well as beyond the front edge of the heat shielding plates disposed between the lowermost heat shielding plate and the top plate, thereby maintaining the top plate in a cool state, and aperture means disposed in said housing and aperture means disposed in said side reflector for introducing ambient air into said housing and into said heating chamber through said side reflector for assisting the discharge of heat from the front opening of the heating chamber.

13. The portable heater of claim 12 wherein an aperture is provided in the front plate of said housing.

14. The portable heater of claim 13 wherein an additional aperture is provided in the rear plate of said housing.

15. The portable heater of claim 12 wherein an aperture is provided in the rear plate of said housing.

16. The portable heater of claim 12 wherein a guide plate is disposed adjacent the aperture in said side reflector for directing the air flow into the heating chamber.

17. A free-standing portable heater comprising:

a housing which includes a top plate, a rear plate and a front plate, said front plate having a front edge portion, said front edge portion and said front plate defining a front opening for discharging heat;

a lower reflector which divides a space in said housing into an upper space and a lower space and is provided above said lower space such that said front plate covers a front portion of said lower space;

a combustion means for generating heat, which projects from said lower space into said upper space;

a side reflector which is disposed behind said combustion means so as to be spaced away from said rear plate such that a rear gap is defined between said side reflector and said rear plate;

a plurality of heat shielding plates which are provided between said combustion means and said top plate so as to define a plurality of convection gaps between said combustion means and said top plate, said convection gaps communicating, at one end, with said rear gap and, at the other end, with said front opening such that cooling air flows into said convection gaps from said one end to said other end thereof, said heat shielding plates and said front plate defining an opening for discharging heat such that said opening occupies a portion of said front opening, said heat shielding plates being inclined obliquely upwardly in a forward direction so as to extend beyond the front edge portion of said top plate, the front end of the lowermost heat shielding plate, extending beyond the front end of the next adjacent heat shielding plate so that front ends of said plurality of heat shielding plates are disposed in a stair step configuration, whereby heat generated from said combustion means is discharged beyond said front edge portion of said top plate as well as beyond the front edge of the heat shielding plates disposed between the lowermost heat shielding plate and the top plate, thereby maintaining said top plate in a cool state; and means for allowing ambient air to flow into said rear gap.

* * * * *